US005915501A

United States Patent [19]

Lodi et al.

[11] Patent Number: 5,915,501

[45] Date of Patent: Jun. 29, 1999

[54] THRESHOLD FOR A LANDING DOOR FOR A LIFT

[75] Inventors: Mario Lodi, Pregnana Mil Milan; Stefano Prandoni, Legnano Milan, both of Italy

[73] Assignee: Kone Oy, Helsinki, Finland

[21] Appl. No.: 08/844,881

[22] Filed: Apr. 22, 1997

[30] Foreign Application Priority Data

Apr. 22, 1996 [IT] Italy ..... TO96A0320

[51] Int. Cl.[6] ..... B66B 13/00

[52] U.S. Cl. ..... 187/333; 52/30

[58] Field of Search ..... 187/333, 332, 187/331, 336, 339, 334, 318; 52/30

[56] References Cited

U.S. PATENT DOCUMENTS

| | | | |
|---|---|---|---|
| 3,584,417 | 6/1971 | Gatton et al. | 49/404 |
| 3,686,808 | 8/1972 | Loomis . | |
| 3,703,788 | 11/1972 | Rivers | 49/307 |
| 3,805,450 | 4/1974 | Forcina | 49/231 |
| 4,781,270 | 11/1988 | Holland . | |
| 5,139,111 | 8/1992 | Baumann et al. | 187/333 |
| 5,293,962 | 3/1994 | Pelvilain | 187/33 |
| 5,305,855 | 4/1994 | Rivera et al. . | |
| 5,469,666 | 11/1995 | Lewis, Jr. | 49/471 |
| 5,794,746 | 8/1998 | Ketonen et al. | 187/333 |

FOREIGN PATENT DOCUMENTS

| | | | |
|---|---|---|---|
| 0548486A1 | 6/1993 | European Pat. Off. . | |
| 402188390 | 7/1990 | Japan | 187/336 |
| 3061287 | 3/1991 | Japan . | |
| 405017091 | 1/1993 | Japan | 187/336 |
| 405078073 | 3/1993 | Japan | 187/336 |
| 5270778 | 10/1993 | Japan . | |
| 550929 | 6/1974 | Switzerland . | |

*Primary Examiner*—William E. Terrell
*Assistant Examiner*—Khoi H. Tran

[57] ABSTRACT

The threshold includes a shaped support plate of steel or the like with a sinuous profile which forms at least one longitudinal, substantially U-shaped loop between two raised portions. A profiled cover element of aluminum or the like is located on the plate and forms at least one guide for guiding the running of a door panel. This guide penetrates into the corresponding loop of the support plate. The threshold further includes fixing devices for anchoring it in the zone connecting the landing and the lift shaft or well.

13 Claims, 3 Drawing Sheets

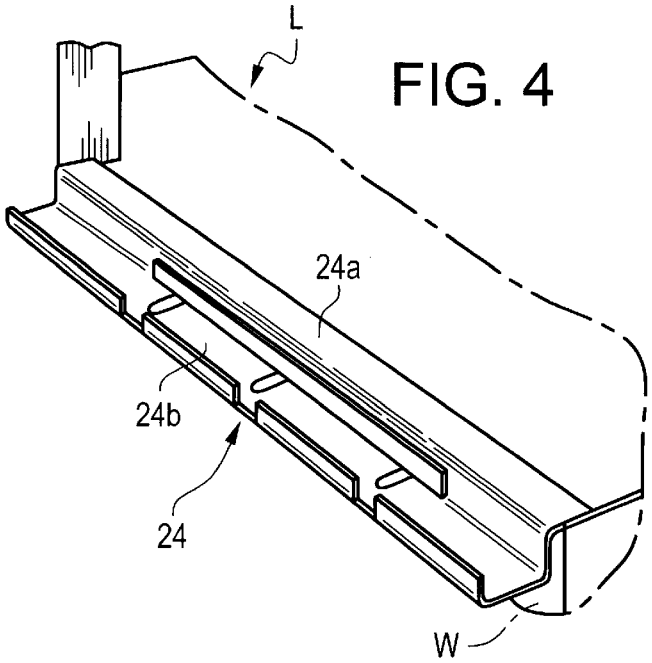
FIG. 4
FIG. 3
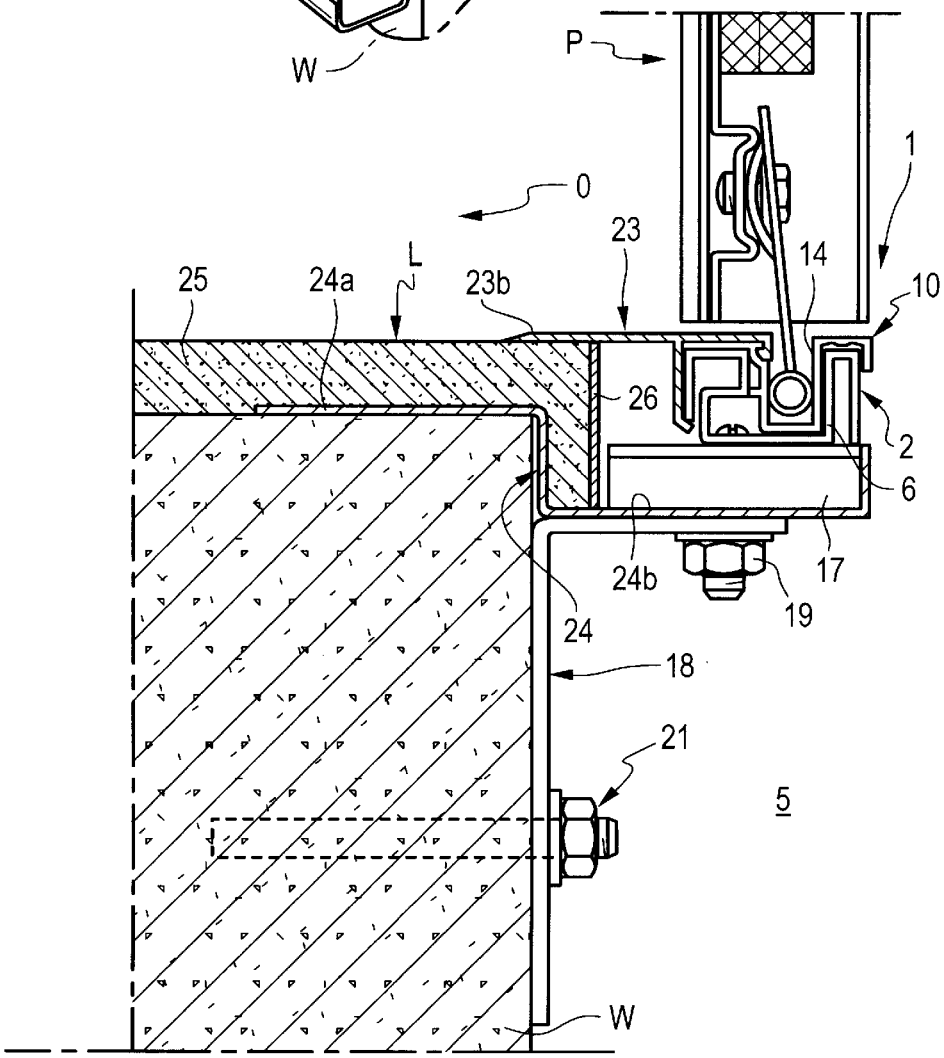

THRESHOLD FOR A LANDING DOOR FOR A LIFT

The present invention relates to a threshold for a landing door for a lift shaft.

The object of the present invention is to provide a threshold for a landing door for a lift which has a simple, robust structure and which is easy to put into operation.

This and other objects are achieved according to the invention by a threshold which comprises a support structure including a plate of steel or the like having a sinuous profile which forms at least one longitudinal, substantially U-shaped loop between two raised portions;

at least one profiled cover element, preferably of aluminum or the like, an intermediate portion of which forms at least one guide for guiding the running of a door panel; the cover element being located with form coupling on the support structure so that the guide extends within the corresponding loop of the support structure; and fixing means for anchoring the support structure adjacent the zone connecting the landing and the lift shaft close to the lower edge of the door opening, with the loop and the associated guide parallel to the edge of the door opening, and with the upper surface of the cover element substantially flush with the landing.

BRIEF DESCRIPTION OF THE DRAWINGS

Further characteristics and advantages of the invention will become apparent from the detailed description which follows, given purely by way of non-limitative example, with reference to the appended drawings, in which:

FIG. 3 shows a variant of the threshold according to the indention; and

FIG. 4 in a perspective view showing a profiled retaining element forming part of the threshold or FIG. 3.

DETAILED DESCRIPTION OF THE PREFERRED EMBODIMENTS

Figure 1:
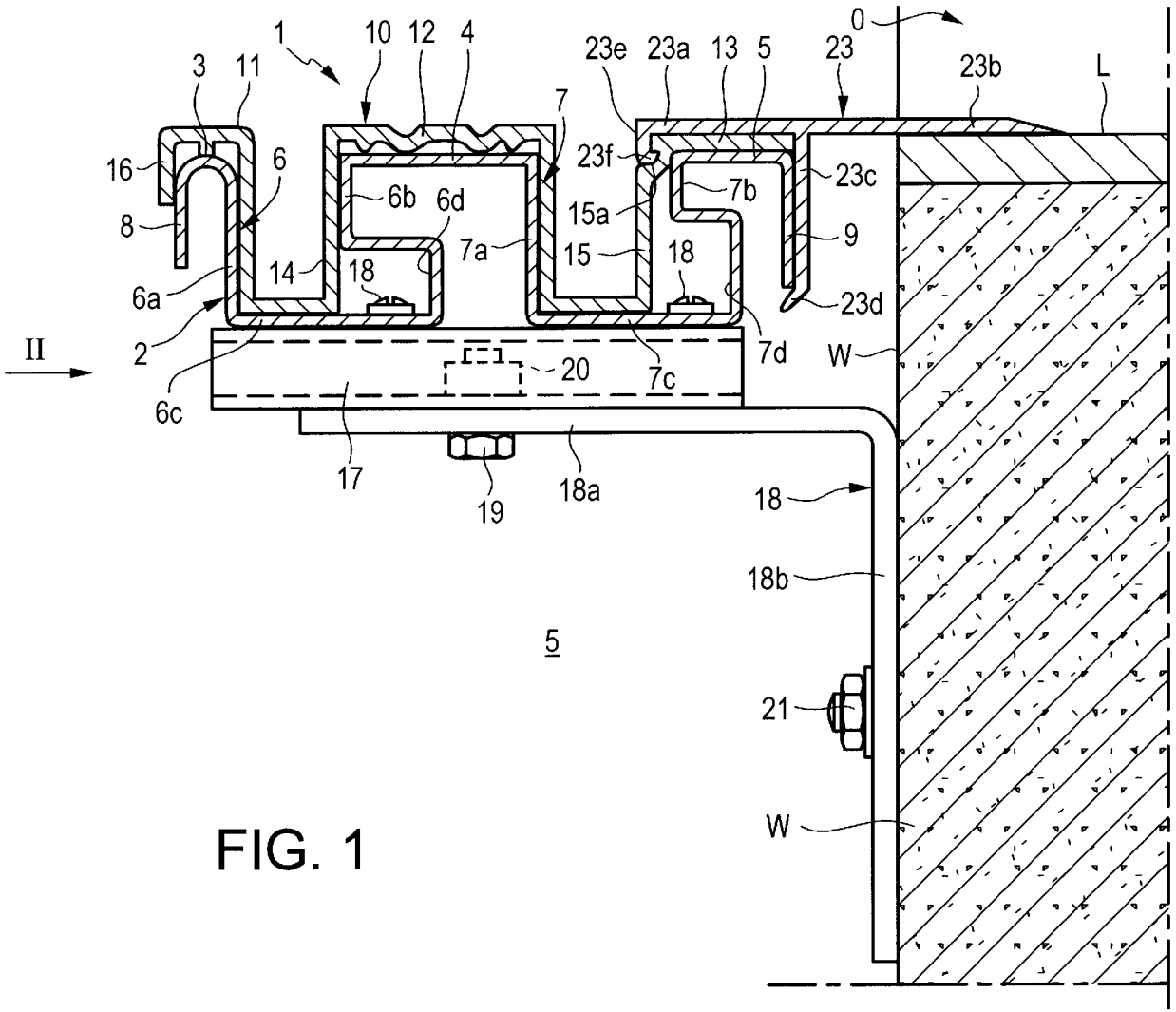
FIG. 1 is a partially-sectioned side view of a threshold according to a preferred embodiment of the invention shown in its assembled condition.

With reference to FIG. 1, a threshold 1 according to the invention includes a support structure constituted by a plate 2 of steel or other metals, plastics, etch, having a sinuous transverse profile.

In the embodiment illustrated, the plate 2 has three raised portions 3, 4 and 5 between which are two longitudinally-extending loop portions 6 and 7 which are upwardly open. These loops have respective, essentially vertical walls 6*a*, 6*b* and 7*a*, 7*b* and respective bases 6*c* and 7*c*.

The lower parts of the walls 6*b* and 7*b* of the loop portions 6 and 7 define respective lateral recesses indicated 6*d* and 7*d* respectively.

The shaped plate 2 also has two substantially vertical edge portions or skirts 8 and 9.

A profiled cover element indicated 10, preferably of aluminum or other metals, plastics, etc., is located on the shaped support plate 2. This profiled element has three raised portions 11, 12, and 13 between which are two channel portions 14 and 15 intended to serve as guides for running members, such as shoes or rollers, of two door panels (not illustrated).

The profiled cover element 10 has an edge portion 16 bent downwardly.

As seen in FIG. 1, the profiled cover element 10 is located on the shaped support plate 2 with form coupling so that the guide channels 14 and 15 extend within the loops 6 and 7 of the support plate. The raised portions 11, 12 and 13 of the profiled cover element 10 rest on the corresponding raised portions 3, 4 and 5 of the steel plate 2. Raised portions 11 and 12 may be elevated from portions 3 and 4, for example by ridges under the portions 11 and 12, in order to be substantially flush with trim element 23, to be described below.

Figure 2:
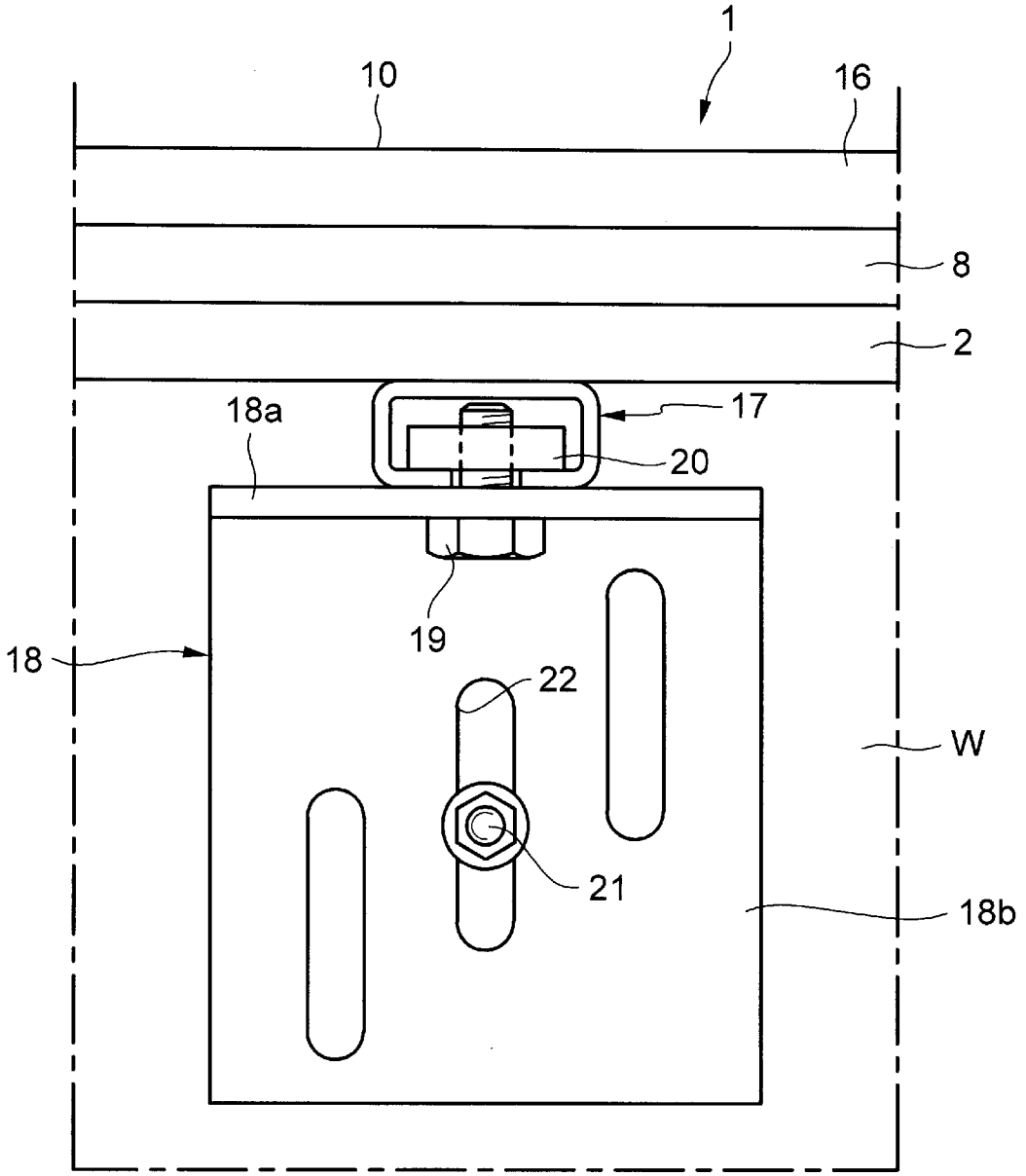
FIG. 2 in a partial view taken from the perspective of arrow II of FIG. 1.

The support plate 2 is fixed to a plurality of beam elements of which only one is visible in FIGS. 1 and 2 where it is indicated at 17. In the embodiment illustrated by way of example, each of the beam elements 17 is of essentially channel section with the channel open downwardly (see FIG. 2).

Conveniently the support plate 2 is connected to the beam elements 17 by connecting members such as screws, bolts, rivets, etc., indicated at 18 in FIG. 1, located in the recesses 6*d* and 7*d* of the loops of this plate. The connecting members are obviously screwed in before the profiled cover element 10 is located on the support plate 2. If necessary, an appropriate opening through the plate 2 and cover element 10 can be included for access to the connecting members 18.

Each beam element 17 is fixed to a horizontal limb 18*a* of an L-shaped bracket 18 by known connecting members such as a bolt 19 and associated nut or like female-thread element 20 (see in particular FIG. 2).

The other limb 18*b* of the bracket 18 is fixed to the wall W of the lift shaft S adjacent the lower edge of the door opening O, for example by means of a bolt 21 which passes through a slot 22 in the bracket.

Each bracket 18 in fixed to the wall W of the lift shaft S at a level below the surface of the landing L (FIG. 1) close to the lower edge of the door opening O so that, in the assembled condition of the threshold, the upper surfaces of the profiled cover element 10 are substantially flush with the landing L.

Appropriate traction surfaces can be formed in or on cover element 10 and trim element 23 in order to prevent people from slipping as they step through the lift doors.

Conveniently the threshold further includes a profiled trim element indicated 23 in FIG. 1, which may be of metal or plastic, etc. In the embodiment illustrated by way of example, this profiled trim element 23 has a substantially T-shaped cross-section with a first upper arm 23*a* which lies over a portion 13 of the profiled cover element 10 and a second arm or limb 23*b* which projects at least partly over the surface of the landing L, covering the space between the landing and the profiled cover element 10.

The profiled trim element 23 also has an essentially vertical stem 23*c* located adjacent the vertical edge portion 9 of the support plate 2. The stem 23*c* of the trim element 23 has a bent lower edge portion 23*d* which engages beneath the edge of the vertical edge portion 9 of the support plate 2.

The horizontal arm 23*a* of the trim element 23 has a downwardly-bent edge portion 23*e* with a tooth-shaped retaining formation 23*f* on its side facing the landing L which engages a cooperating groove 15*a* in the cover element 10 thus acting as a detent. The trim element 23 is thus firmly connected to the cover element 10 and to the support plate 2. It may, however, easily be removed by slight resilient deformation to allow its bent lower edge 23*d* to be disengaged from the bottom edge of the edge portion 9 of the support plate 2 and then the toothed formation 23*f* to be removed from the groove 15*a*.

The threshold described above with reference to FIGS. 1 and 2 is intended for use with a landing door for a lift in which the door has two door panels which run in the guide channels 14 and 15 of the profiled element 10.

FIG. 3 shows a variant of the threshold of the invention for a door having only one door panel indicated P. For this purpose the support plate 2 forms a single loop indicated 6 and, correspondingly, the profiled cover element 10 forms a single guide channel 14.

In the embodiment of FIG. 3, the threshold 1 further includes a profiled retaining element 24 (see also FIG. 4) which has a horizontal limb 24*a* located on the plane of the landing L before the laying or casting of a layer 25 of material for covering the landing, such as mortar, cement or the like. The limb 24*a* of the retaining element 24 is joined to a portion 24*b* of this profiled element which is essentially channel shaped and has a base interposed between the beam elements 17 and the associated support brackets 18. As seen in FIG. 3, when the limb 24*a* of the profiled element 24 is in its position of use, it is covered by the layer 25 of material which covers the landing L. Some of this material 25 may also be introduced into the channel portion 24*b* of this profiled element, extending as far as a vertical partition indicated 26 in FIG. 3 which bears against the beam elements 17.

The limb 23*b* of the profiled trim element 23 rests on the layer 25 which covers the landing L.

Although the use of a profiled retaining element 24 has been illustrated in a threshold with a single guide channel for the running of a door panel, obviously such a profiled retaining element may also be incorporated in a threshold with two or more guide channels, such as that described previously with reference to FIGS. 1 and 2.

Naturally, the principle of the invention remaining the same, the forms of embodiment and details of construction may be varied widely with respect to those which are described and illustrated in this disclosure purely by way of non-limitative example, without thereby departing from the scope of the present invention.

We claim:

1. A threshold at a landing of a lift shaft comprising:

a folded support plate forming at least one longitudinal, substantially U-shaped loop defined by two vertical walls extending from a horizontal base, said support plate including two raised portions extending outwardly from said vertical walls in a direction parallel to said horizontal base and away from said loop; and at least one profiled cover element forming at least one guide for guiding the running of a door panel in a direction parallel to said loop, said cover element including two raised portions extending outwardly from the guide, said cover element being coupled to said plate such that the guide is aligned with said loop;

wherein said horizontal base and said two vertical walls of said support plate contact and support the guide formed by said cover element, and said two raised portions of said support plate contact and support said two raised portions of said cover element.

2. The threshold according to claim 1, further comprising:

fixing means for anchoring said cover plate close to a lower edge of a door opening at the landing, with said loop and the guide parallel to the edge of the door opening, and with an upper surface of said cover element substantially flush with the landing.

3. The threshold according to claim 2, wherein said fixing means includes a profiled retaining element having an extended limb for projecting into a wall of the landing, when installed.

4. The threshold according to claim 1, wherein said support plate forms two parallel, substantially U-shaped loops between three raised portions, and said cover element forms two guides between three raised portions.

5. The threshold according to claim 4, further comprising a profiled trim element coupled to said cover element and having at least one projecting limb which, when said threshold is installed, projects at least partly over the surface of the landing thereby covering space between the landing and said cover element.

6. The threshold according to claim 5, wherein said profiled trim element has a substantially T-shaped cross-section with a first upper arm lying over one of said raised portions of said cover element, a second upper arm which constitutes said projecting limb, and a vertical stem adjacent an edge of said plate.

7. The threshold according to claim 6, wherein said trim element further includes a bent appendage which engages beneath said edge of said plate, and said first upper arm has a downwardly bent portion with a toothed retaining formation which engages a groove in said cover element.

8. The threshold according to claim 1, further comprising a profiled trim element coupled to said cover element and having at least one projecting limb which, when said threshold is installed, projects at least partly over the surface of the landing thereby covering space between the landing and said cover element.

9. The threshold according to claim 1, wherein said at least one loop includes a lateral recess which, during assembly, allows introduction and putting into operation of at least one connecting member for connecting said support plate to a beam element.

10. The threshold according to claim 1, further comprising at least one L-shaped bracket having a first limb which, when assembled, extends horizontally and another limb which, when assembled, extends horizontally and another limb for fixing to a wall of the lift shaft, and at least one beam element fixed to said first limb and to said support plate.

11. The threshold according to claim 10, wherein said beam element has a downwardly facing channel.

12. The threshold according to claim 10, further comprising a profiled retaining element having an extended limb for projecting into the landing, when installed, and a channel adjacent said extended limb, a base of said channel being interposed between said beam element and said L-shaped bracket, said extended limb being covered by a layer of material covering the landing, said trim element bearing on the layer of material.

13. The threshold according to claim 1, wherein said guide extending within said loop.

* * * * *